US008483416B2

(12) United States Patent
Roeck et al.

(10) Patent No.: US 8,483,416 B2
(45) Date of Patent: Jul. 9, 2013

(54) METHODS FOR MANUFACTURING AUDIBLE SIGNALS

(75) Inventors: Hans Ueli Roeck, Hombrechtikon (CH); Raoul Glatt, Zurich (CH); Ralph Peter Derleth, Hinwil (CH)

(73) Assignee: Phonak AG, Staefa (CH)

( * ) Notice: Subject to any disclaimer, the term of this patent is extended or adjusted under 35 U.S.C. 154(b) by 1300 days.

(21) Appl. No.: 11/456,874

(22) Filed: Jul. 12, 2006

(65) Prior Publication Data

US 2008/0013762 A1 Jan. 17, 2008

(51) Int. Cl.
*H04R 25/00* (2006.01)

(52) U.S. Cl.
USPC ..... 381/313; 381/312; 381/320

(58) Field of Classification Search
USPC ..... 381/23.1, 310–313, 315, 74, 92, 381/320, 323; 29/896.21
See application file for complete search history.

(56) References Cited

U.S. PATENT DOCUMENTS

| | | | | |
|---|---|---|---|---|
| 5,604,812 | A | 2/1997 | Meyer | |
| 5,615,229 | A | 3/1997 | Sharma | |
| 5,651,071 | A | 7/1997 | Lindemann et al. | |
| 5,991,419 | A | 11/1999 | Brander | |
| 6,389,142 | B1 | 5/2002 | Hagen | |
| 6,449,216 | B1 | 9/2002 | Roeck | |
| 6,778,674 | B1 | 8/2004 | Panasik et al. | |
| 7,212,643 | B2 * | 5/2007 | Bock | 381/330 |
| 7,286,672 | B2 * | 10/2007 | Roeck | 381/23.1 |
| 7,664,272 | B2 * | 2/2010 | Terai et al. | 381/17 |
| 7,970,144 | B1 * | 6/2011 | Avendano et al. | 381/1 |
| 2002/0041695 | A1 | 4/2002 | Luo | |
| 2004/0175005 | A1 | 9/2004 | Roeck | |
| 2004/0175008 | A1 * | 9/2004 | Roeck et al. | 381/312 |
| 2004/0175009 | A1 | 9/2004 | Niederdrank | |
| 2004/0175012 | A1 * | 9/2004 | Roeck et al. | 381/317 |
| 2007/0160242 | A1 * | 7/2007 | Cadalli et al. | 381/312 |
| 2007/0230714 | A1 * | 10/2007 | Armstrong | 381/74 |
| 2008/0212810 | A1 * | 9/2008 | Pedersen | 381/312 |

FOREIGN PATENT DOCUMENTS

| | | | |
|---|---|---|---|
| DE | 19948907 | A1 | 2/2001 |
| DE | 19944467 | A1 | 3/2001 |
| DE | 10048354 | A1 | 5/2002 |
| DE | 10304648 | B3 | 8/2004 |
| EP | 0855130 | B1 | 7/1998 |
| EP | 0941014 | A2 | 9/1999 |

(Continued)

OTHER PUBLICATIONS

Partial International Search Report, dated Feb. 12, 2007, parallel PCT application EP2006/064123 filed Dec. 7, 2006.

(Continued)

*Primary Examiner* — Disler Paul
(74) *Attorney, Agent, or Firm* — Pearne & Gordon LLP

(57) ABSTRACT

So as to put binaural beam-forming into practice selected acoustical situations are dealt with having minimum processing power and power consumption ability at a binaural hearing system. For near-to-ear acoustical sources the contralateral ($7_L$) as well as the ipsi-lateral ($7_R$) output electrical-to-mechanical converters of two hearing devices of the binaural hearing system are operated substantially exclusively in dependency from the output signal of the one ipsi-lateral input acoustical-to-electrical converter arrangement ($3_R$).

18 Claims, 8 Drawing Sheets

FOREIGN PATENT DOCUMENTS

Figure 1:
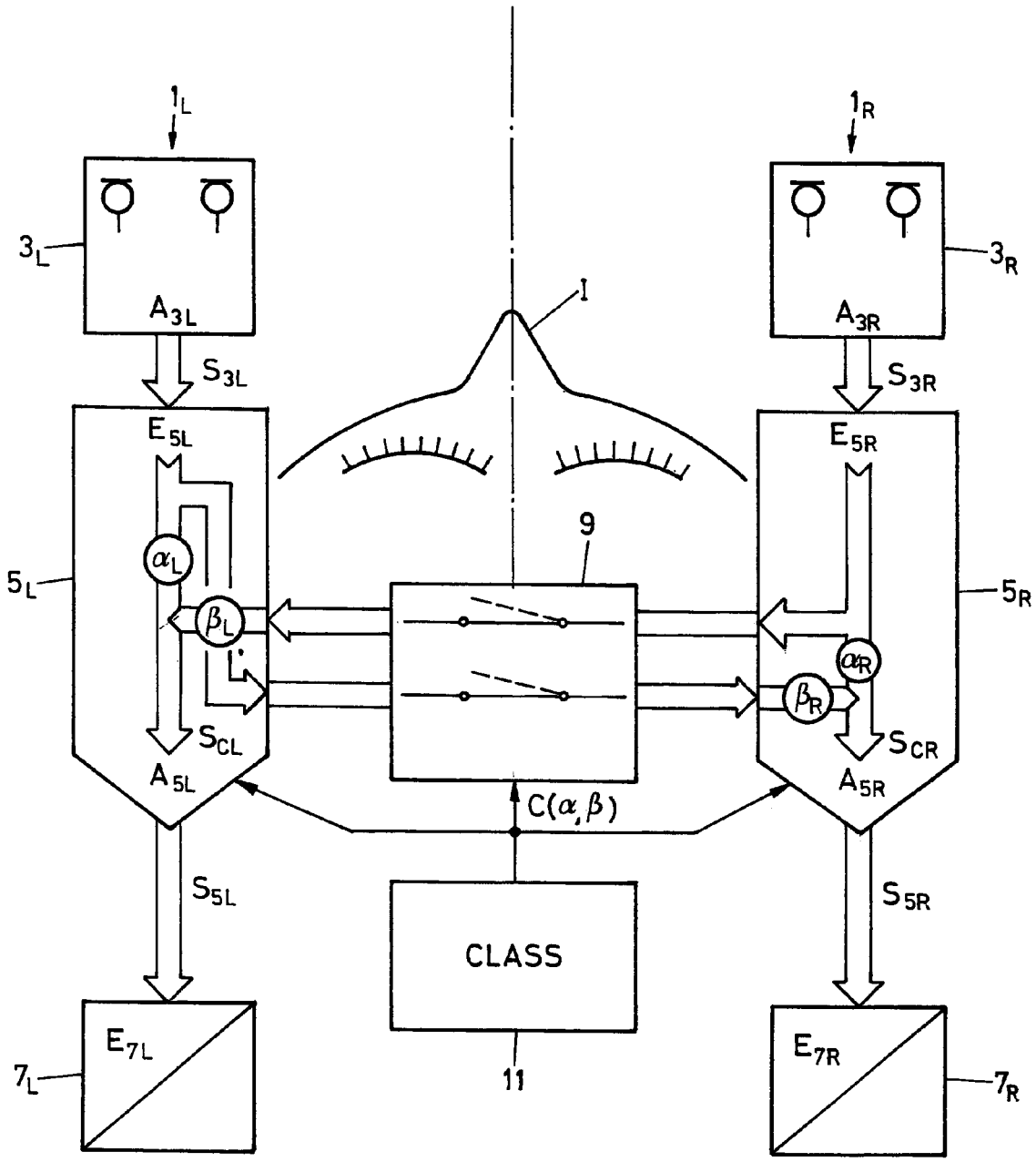

| | | | |
|---|---|---|---|
| EP | 1203508 | B1 | 5/2002 |
| EP | 1320281 | A2 | 6/2003 |
| EP | 1326478 | A2 | 9/2003 |
| EP | 1360870 | B1 | 11/2003 |
| EP | 1379102 | A2 | 1/2004 |
| EP | 1389035 | A2 | 2/2004 |
| EP | 1406470 | A2 | 4/2004 |
| EP | 1445982 | A1 | 8/2004 |
| EP | 1448021 | A2 | 8/2004 |
| EP | 1465456 | A2 | 10/2004 |
| WO | 97/14268 | A1 | 4/1997 |
| WO | 00/65872 | A1 | 11/2000 |
| WO | 0068703 | A2 | 11/2000 |
| WO | 0228143 | A2 | 4/2002 |
| WO | 2004110099 | A2 | 12/2004 |

OTHER PUBLICATIONS

E.M. Wenzerl, J.D. Miller, J.S. Abel: "Sound Lab: A real-time, software-based system for the study of spatial hearing" AES-AN Audio Engineering Society Preprint, [Online} XP002426646. Retrieved from the Internet: URL: http://pddocserv/specdocs/data/handbooks/AES/Convo-Preprints/2000/PP0002/5140.pdf>[retrieved on Feb. 19, 2000] p. 8, line 13-p.8, line 26; figs. 7-11.

Tom Erbe: "SoundHack—user's manual—(Command-M) Mutation" [Online] XP002426647, Retrieved from the Internet: URL: http://web.archive.org/web/20050304065230/www.madstudio.lsu.edu/references/music/soundhack/GainMuta.html> [retrieved on Mar. 4, 2005] the whole document.

International Search Report dated Apr. 11, 2007.

* cited by examiner

KEMAR:
Cardoid(---)

METHODS FOR MANUFACTURING AUDIBLE SIGNALS

The present invention resides in the field of binaural hearing systems.

Definition:

We understand under a "binaural hearing system" a system which comprises two hearing devices, one for each ear of an individual. Such hearing devices of a binaural hearing system do mutually communicate. The hearing devices may be equal with the exception of their ear-specific shape or may be different. This within the frame of devices which are subsumed under the term "hearing device":

We understand under a "hearing device" a device which is worn adjacent to or in an individual's ear with the object to improve individual's acoustical perception. Such improvement may also be barring acoustical signals from being perceived in the sense of hearing protection for the individual.

If the hearing device is tailored so as to improve the perception of a hearing impaired individual towards hearing perception of a "standard" individual, then we speak of a hearing aid device.

With respect to the application area a hearing device may be applied behind the ear, in the ear, completely in the ear canal or may be implanted.

Further, the present invention is largely involved with beam-forming.

Definition:

We understand under technical "beam-forming" tailoring the amplification of an electrical signal with respect to an acoustical signal as a function of direction of arrival DOA of the acoustical signal relative to a predetermined spatial direction. Customary the beam characteristic is represented in polar diagram form and scaled in dB.

Most generically, technical beam-forming is always achieved if the output signals of two spaced input acoustical-to-electrical converter arrangements are processed to result in a combined output signal.

Technical beam-forming is known as one effective method to improve speech intelligibility. Thereby, current beam-forming methods for binaural hearing systems which are on the market act—to the knowledge of the inventors—monaurally. This means that at each hearing device beam-forming is performed separately. Beam-forming by the binaural hearing system considered as one processing entity is not exploited.

Nevertheless, binaural beam-forming methods are known and described in the literature. Considering that often beam-forming makes use of the phasing difference of acoustical signals impinging at at least two loci which are mutually distant by a known spacing, it is evident that binaural systems with respective acoustical-to-electrical input converter arrangements at each ear, are most suited to provide for "two ear", i.e. binaural beam-forming.

In opposition to "technical" beam-forming, which is performed by technical means, we understand under "natural" beam-forming the ability of human's body, particularly of human's head, to transfer acoustical signals to the respective ear with an amplification which varies as a function of DOA.

When we speak just of beam-forming without specifying whether we mean "technical" or "natural" then we address technical beam-forming.

We understand within the frame of a binaural hearing system, under technical "monaural beam-forming", the beam-forming as performed separately at the respective hearing devices. We understand within the frame of such a system under "binaural beam-forming" beam-forming which exploits the mutual distance between individual's ears.

Thereby, it must be considered that providing monaural beam-forming separately at both hearing devices leads to complete loss of acoustical orientation. The individual may not anymore acoustically localize an acoustical source in the surrounding neither with respect to direction of arrival, nor with respect to distance. The ability to preserve or reinstall such acoustical localization is one of the most important advantages which may be achieved with correctly performed binaural beam-forming, whereat, per definitionem, a "cross"-communication is established between the hearing devices. The correct interaural time difference—ITD—may be preserved which is decisive for perceiving direction of arrival of acoustical signals. As perfectly known to the skilled artisan this ITD is a function of direction of arrival, DOA.

Further, the binaural beam-forming may also help to preserve or reinstall interaural level difference, ILD, which is decisive for distance estimation.

Definitions:

We understand under "direction of arrival DOA" the direction in which an acoustical source "sees" the center of individual's head. We define angles of direction of arrival DOA in a counter clockwise positive sense relative to the ahead direction in the sagittal plane of individual's head, seen from top to bottom.

We understand under "interaural time delay ITD" the time delay with which an acoustical signal impinges on both ears. Such time delay accords with a phasing difference and is dependent from DOA, the mutual distance of the ears and the head-related transfer function (HRTF).

We understand under "interaural level difference ILD" the difference of pressure level with which an acoustical signal impinges on both ears. This entity is dependent from DOA and the head-related transfer function.

We understand under "head-related transfer function" the natural beam-forming ability of individual's head.

Thus, there is a large demand for practicable binaural beam-forming.

One reason which probably bars today the practicability of binaural beam-forming is power consumption by practicable interdevice communication links as by a wireless link substantially permanently cross-transmitting audio signal representing data between the hearing devices. Another reason might be the necessity of large computing resources with respective power consumption, as binaural beam-forming methods tend to use significant amounts of processing power to achieve the desired performance. Still a further reason which may bar today's practicability is lacking robustness of binaural beam-forming with respect to artifacts which problem rather rises with increased complexity of system dynamics.

Definitions:

Throughout the present description and claims we further establish the following convention:

When we speak of an "input converter arrangement" we then understand an input "acoustical-to-electrical" converter arrangement. Such an arrangement is very often a microphone arrangement. Therefore and for the ease of readability we also speak of a "microphone arrangement", thereby addressing a more generic "acoustical-to-electrical converter arrangement".

When we speak of an "output converter arrangement" then we understand an output "electrical-to-mechanical" converter arrangement. Such an arrangement is very often a loudspeaker arrangement. Therefore and for the ease of readability we also speak of a "speaker arrangement", thereby addressing a more generic "electric-to-mechanical" converter arrangement.

It is known e.g. from the EP 1 320 281, according to US application No. US 2004/0175005 of the same applicant as the present application, to monitor and classify an instantaneously prevailing acoustical surrounding of an individual. An important classifying parameter is DOA. This parameter in fact angularly structures the acoustical environment with respect to acoustical sources. In dependency of the classifying result one of at least two, mostly of several programs at the binaural hearing system is selected. The programs differ in overall acoustical-to-mechanical transfer characteristic. Such different programs may thereby comprise establishing different binaural beam-forming characteristics.

According to the teaching of the addressed reference the input signals to the right-ear and to the left-ear speaker arrangements are both dependent from output signals of both, left-ear and right-ear microphone arrangements. The respective dependencies of the addressed signals are variably weighted, leading to very high flexibility with respect to overall beam-forming including binaural and monaural.

Weighting adjustment is controlled by the classifying results.

Summarizing, on one hand it is theoretically possible to conceive very sophisticated, accurate and advantageous binaural hearing systems, but putting such systems into practice fails e.g. due to power consumption and processing power requirements.

The present invention targets towards making binaural beam-forming more practicable.

Under a first aspect of the present invention this object is followed up by a method for manufacturing an audible signal to be perceived by an individual in dependency from an acoustical signal source, whereby the individual wears a right-ear and a left-ear hearing device, respectively with a right-ear and with a left-ear microphone arrangement and with a right-ear and with a left-ear speaker arrangement. The input signal of the right-ear speaker arrangement is dependent from the output signal of the right-ear microphone arrangement. The input signal of the left-ear speaker arrangement is dependent from the output signal of the left-ear microphone arrangement.

Only when an acoustical signal source to be perceived is located laterally of individual's head in a range of DOA which is $$45° \leqq DOA \leqq 135°$$

or $$225° \leqq DOA \leqq 315°$$

relative to individual's horizontal straight-ahead direction, a predominant dependency of the input signal of the contra-lateral speaker arrangement from the output signal of the ipsi-lateral microphone arrangement is established.

Figure 3:
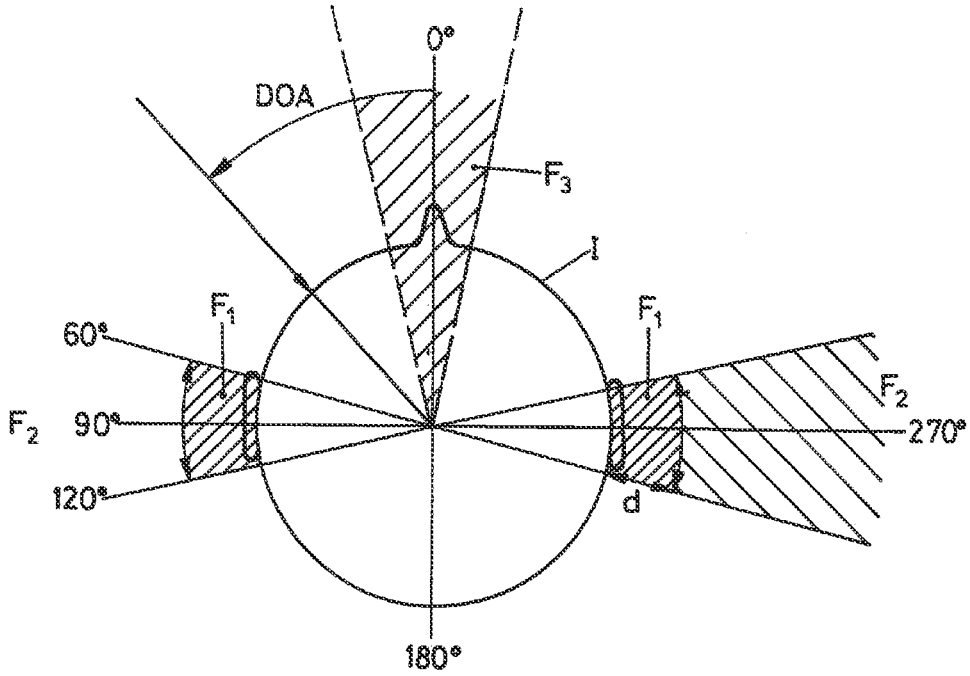
Figure 4A:
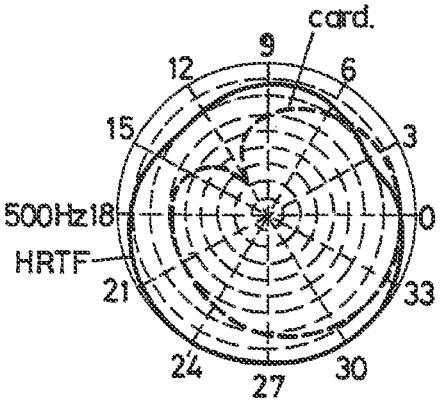
Figure 4B:
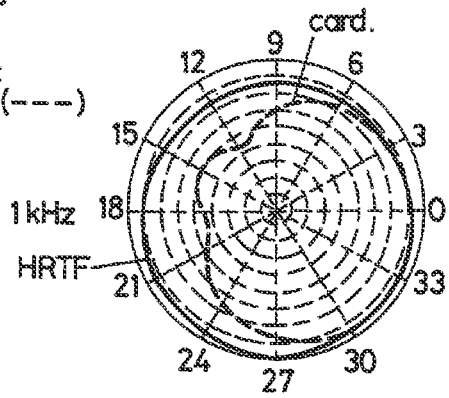
Figure 4C:
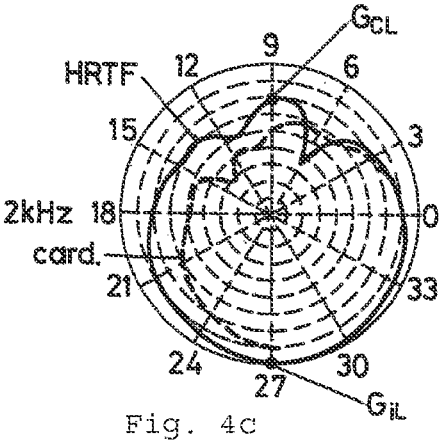
Figure 4D:
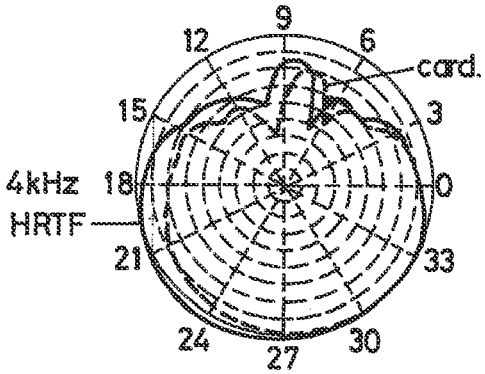

Definition:

With respect to definition of DOA, please refer to FIG. 3.

We understand under "ipsi-lateral" that side of individual's head which is closer to an acoustical source. Accordingly, we understand under "contra-lateral" that side of individual's head which is more remote from a lateral acoustical source.

By establishing a predominant dependency of the input signal of the contra-lateral speaker arrangement from the output signal of the ipsi-lateral microphone arrangement the contra-lateral speaker arrangement becomes substantially fed with a signal dependent from the signal sensed at the ipsi-lateral side and thus with an improved S/N ratio signal. There is established a distinct acoustical situation at which the addressed binaural beam-forming is exclusively established.

In one embodiment, the dependency of the input signal of the contra-lateral speaker arrangement from the output signal of the contra-lateral microphone arrangement is reduced.

As data transfer from the contra-lateral microphone arrangement to the contra-lateral speaker arrangement is reduced some, reduction of power consumption is compensating for added cross-over transmission from the ipsi-lateral hearing device to the contra-lateral hearing device. The ipsi-lateral hearing device becomes the "leading" device in the specific acoustical situation.

Still in a further embodiment of the method according to the present invention a dependency of the input signal of the ipsi-lateral speaker arrangement from the output signal of the contra-lateral microphone arrangement is at least substantially disabled for the addressed situation. A device-to-device cross-communication is established exclusively consisting of communication from the ipsi-lateral microphone arrangement to the contra-lateral speaker arrangement. This allows for considerable processing power and power consumption savings.

The method for manufacturing the audible signal according to the present invention and as has been described up to now is especially suited for perceiving acoustical signals of sources which, besides of being situated within the addressed ranges of DOA, are distant from the respective one of individual's ears by at most 0.3 m.

In an other embodiment or additionally to that just discussed, in another acoustical situation binaural beam-forming is performed by establishing dependency of the input signal of the right-ear speaker arrangement from the output signal of the left-ear microphone arrangement and dependency of the input signal of the left-ear speaker arrangement from the output signal of the right-ear microphone arrangement at least for DOA outside the range addressed above.

According to a further embodiment this binaural beam-forming processing is established not only outside the addressed DOA range, but within a second specific range of DOA.

Still in a further embodiment the influences of the output signals of the right- and of the left-ear microphone arrangements cross-wise on the input signals of the left- and right-ear speaker arrangements are delayed more by a fixed amount of time than time delaying the influences of the output signals of the right-ear and of the left-ear microphone arrangements on the input signals of the respective right-ear and left-ear speaker arrangements. Thereby, still in a further embodiment this fixed amount of time is selected at least approx. equal to the time an acoustical signal in the hearable frequency range needs to run from one ear to the other ear around human's head.

By the addressed fixed amount the ITD is approximated, leading on one hand to a satisfyingly good sensation of localization of the acoustical source by the individual and leading, on the other hand, to substantially reduced processing requirements compared with DOA-dependent time delaying to establish source localization as accurately as possible.

In a further embodiment of the method according to the present invention the right-ear and the left-ear microphone arrangements are conceived to have in situ and at least for a part of the frequencies within the audible frequency band monaural beam-forming ability leading to an amplification maximum for a DOA from the lateral hemisphere of the individual and to an amplification minimum for a DOA from the head sided hemisphere of the individual.

Thereby, in one further embodiment the addressed manual beam-forming ability comprises exploiting at least predominantly the respective head-related transfer function, i.e. a natural beam-forming ability.

By paying attention that at each hearing device the head-related transfer function is preserved as it occurs in situ, monaural, natural beam-forming is achieved which already suffices to improve signal-to-noise ratio for laterally located acoustical sources.

Thereby, no additional technical beam-forming is necessary.

Still in a further embodiment binaural beam-forming is disabled in a DOA range from at most 45° to at least 315°, thus whenever the acoustical source is located in front of the individual in a range of ±45°. Thereby, additional savings of power consumption and processing power are achieved.

The different processing modes, as addressed to now, are characterized by respective different signal dependencies between output signals of the microphone arrangements and input signals of the speaker arrangements.

In one further embodiment of the present invention switching from one signal dependency status to another is performed in a fading manner, i.e. without perceivable transition.

In one mode to do so the dependencies of the input signals of the output converter arrangements from output signals of the input converter arrangements comprise signal processing in frequency mode. After a respective analogue to digital conversion downstream the respective acoustical inputs, a time-domain to frequency-domain conversion is thus performed.

The addressed fading from one signal dependency to the other is, in one embodiment, performed by changing a signal dependency of at least two groups of spectral components subsequently in time. For performing switching from a first dependency, which may be defined by a first transfer function, to a second dependency, which may be defined by a second transfer function, at first a first group of spectral signal components—belonging to a first group of spectral frequencies—is switched to the second transfer function, whereas a second group of spectral components—belonging to a second group of spectral frequencies—is still processed by the first transfer function. Then the second group of spectral components is also switched to the second transfer function, and thus the overall signal, comprising the two groups of spectral components, has been switched in a fading manner from one dependency or transfer function to a second one.

Generically switching signal processing from a first transfer function to a second transfer function in a fading manner is often required and is resolved in different ways necessitating rather complex process control.

Under a further generic aspect of the present invention a method for manufacturing an audible signal to be perceived by an individual in dependency from an acoustical signal is proposed, whereat such switch-over of signal processing is performed in a fading manner, i.e. substantially without artifacts disturbing the individual in the transition phase.

Definition:

We define throughout the present description and claims as a "transfer function" the ratio of an output signal to an input signal considered with respect to the input and the output at a signal propagation path or "black box".

Under the addressed further aspect the individual wears at least one microphone arrangement and at least one speaker arrangement. The input signal of the speaker arrangement is dependent from the output signal of the microphone arrangement via at least two controllably interchangeable transfer functions. Changing from a first transfer function to the second in a controlled manner comprises performing time-domain to frequency-domain conversion upstream the addressed transfer functions. Then signal processing of a first group of spectral components is maintained to be performed via the first transfer function and signal processing of a second group of spectral components is changed so as to be performed via the second transfer function. Then signal processing of the first group is changed over to be done via the second transfer function as well, whereby signal processing of the second group is maintained to be performed via the second transfer function.

Thus, staggered in time at least two groups of spectral components of the signal to be processed are switched from one transfer function to the other. Clearly, grouping of the spectral components of the signal in more than two groups may be done to render the fading effect even smoother.

Under an even more generalizing aspect there is proposed a method for controllably transiting from a first to a second processing of a signal, which comprises time-domain to frequency-domain converting of the signal and performing the transiting frequency-selective and staggered in time.

The addressed method under the second aspect of the present invention allows fadingly switching from one signal processing to another, especially at a hearing device, with substantially reduced or even without transient artifacts for the individual wearing the hearing device.

Still under a further aspect of the present invention as was already addressed binaural beam-forming is only applied if necessary, is performed in simplified processing mode wherever possible and is only in fact exceptionally performed in full crosswise interdevice communication mode.

The present invention provides for a method of manufacturing an audible signal in which selected specific processing types are controllably applied. A method is proposed for manufacturing an audible signal to be perceived by an individual in dependency from an acoustical signal source. The individual wears a right-ear as well as a left-ear hearing device respectively with a right-ear and with a left-ear microphone arrangement and with a right-ear and with a left-ear speaker arrangement. Further, the input signal of the right-ear speaker arrangement is—normally—dependent from the output signal of the right-ear microphone arrangement and the input signal of the left-ear speaker arrangement is—again normally—dependent from the output signal of the left-ear microphone arrangement. If necessary, such dependencies may be disabled or gradually reduced in binaural processing.

The addressed method comprises performing in a controlled manner alternatively—controlled e.g. by a classifier—at least two of the following processings:

a) Binaural beam-forming by establishing an at least predominant dependency of the input signal of the right-ear and of the left-ear speaker arrangements from the output signal of the left-ear or of the right-ear microphone arrangement, respectively;

b) binaural beam-forming by establishing dependency of the input signal of the left-ear speaker arrangement from the output signal of the right-ear microphone arrangement, and vice versa for the right-ear speaker arrangement;

c) Binaural beam-forming by establishing a dependency of the input signal of the left-ear speaker arrangement from the output signal of the right-ear microphone arrangement and a dependency of the input signal of the right-ear speaker arrangement from the output signal of the left-ear microphone arrangement, thereby realizing a beam characteristic with minimum amplification in ahead and in backwards direction with respect to individual's head;

d) binaural beam-forming as addressed under c), realizing thereby a beam characteristic which has a maximum amplification in backwards direction with respect to individual's head;

e) disabling binaural beam-forming.

In a further embodiment of the method according to the present invention under the aspect just addressed performing processing according to a) is done only when an acoustical signal source is to be perceived, which is situated lateral to individual's head and in a first predetermined DOA range.

In a further embodiment of the addressed method processing according to a) is selected for telephone applications or for a driver-to-front-seat-passenger communication.

Still in a further embodiment, whereat processing a) is performed in the addressed first range of DOA, processing b) is performed only when an acoustical signal source to be perceived is situated in a second predetermined DOA range, which is different from the first range.

Still in a further embodiment processing c) is selected as stereo enhancement processing.

Still in a further embodiment processing d) is selected when an acoustical signal source to be perceived is situated behind individual's head. This may e.g. be the case for driver-to-rear-seat-passenger communication situations.

Still in a further embodiment processing according to e) is performed, whenever the acoustical signal source to be perceived is located ahead i.e. in front of the individual.

Still in a further embodiment the change between the addressed at least two processing modes is performed in a fading manner. Such fading manner is thereby realized, in a further embodiment, by establishing the addressed signal dependencies so as to comprise signal processing in frequency-domain. Changing signal processing comprises performing changing processing subsequently in time in at least two groups of spectral components of the signal processed.

The invention under all its aspects shall now further be exemplified to the skilled artisan with the help of figures, whereby the above teaching and the further exemplification of the invention opens to the skilled artisan a large variety of realization modes of the present invention.

Figure 2:
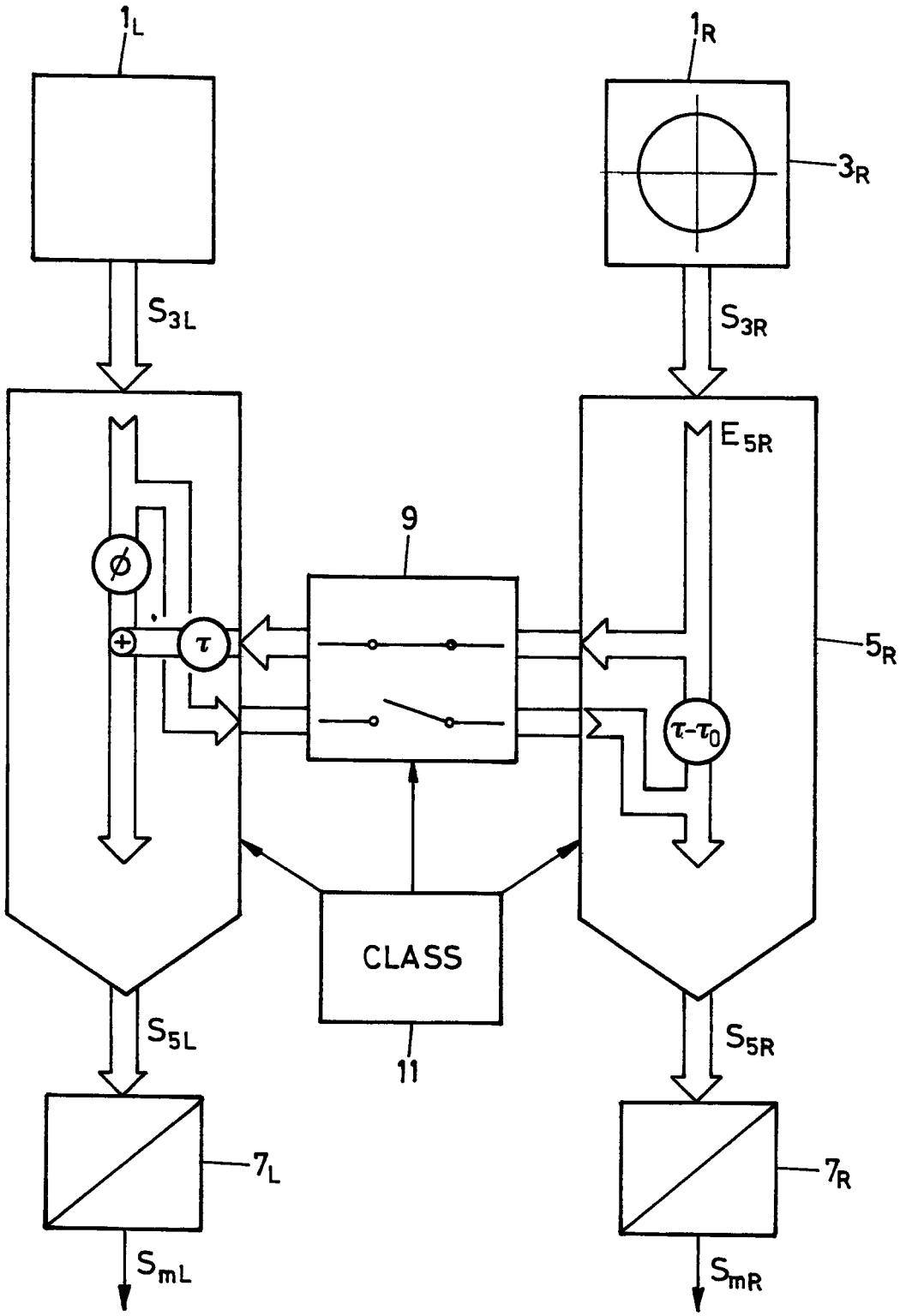
Figure 5:
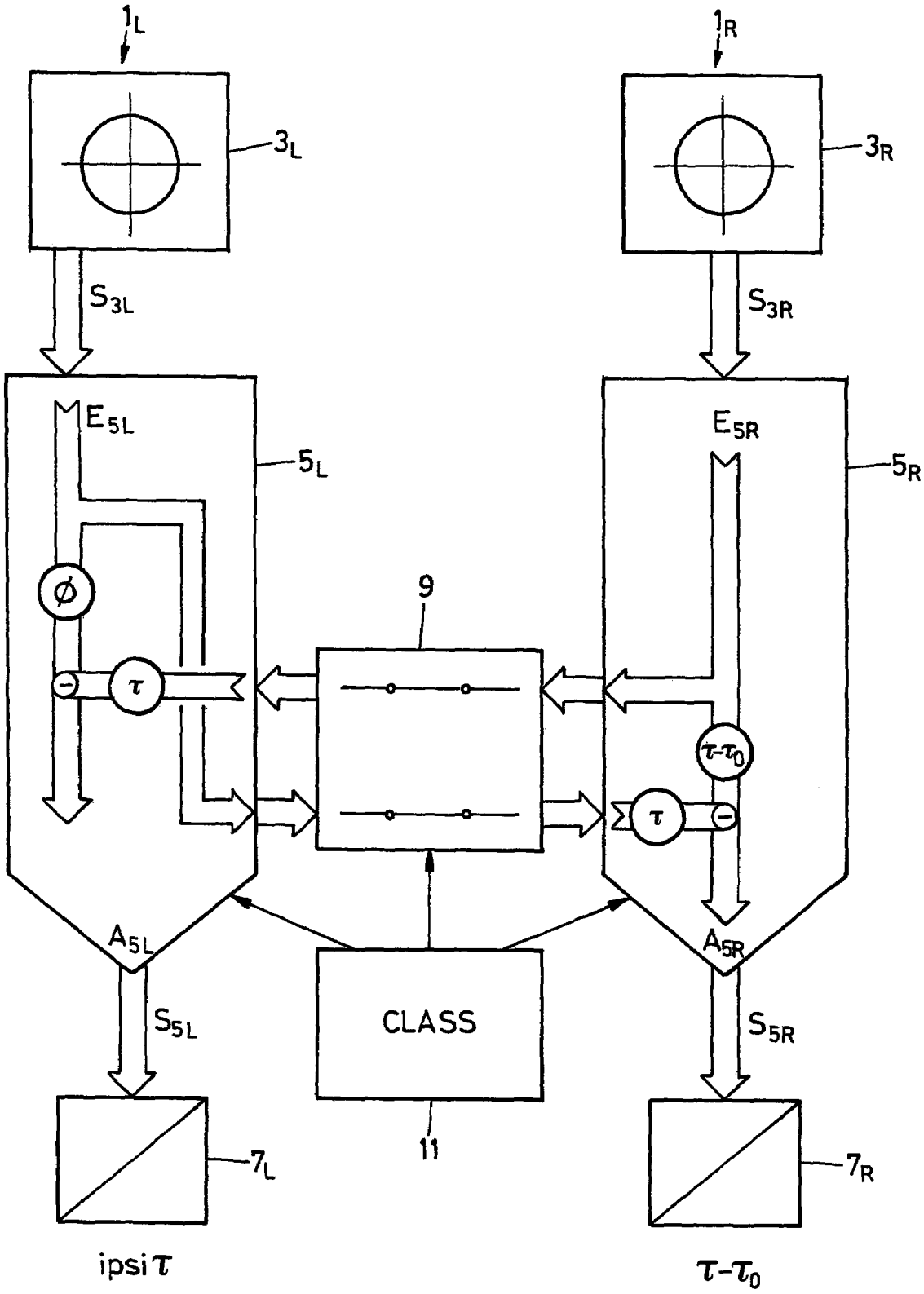
Figure 6:
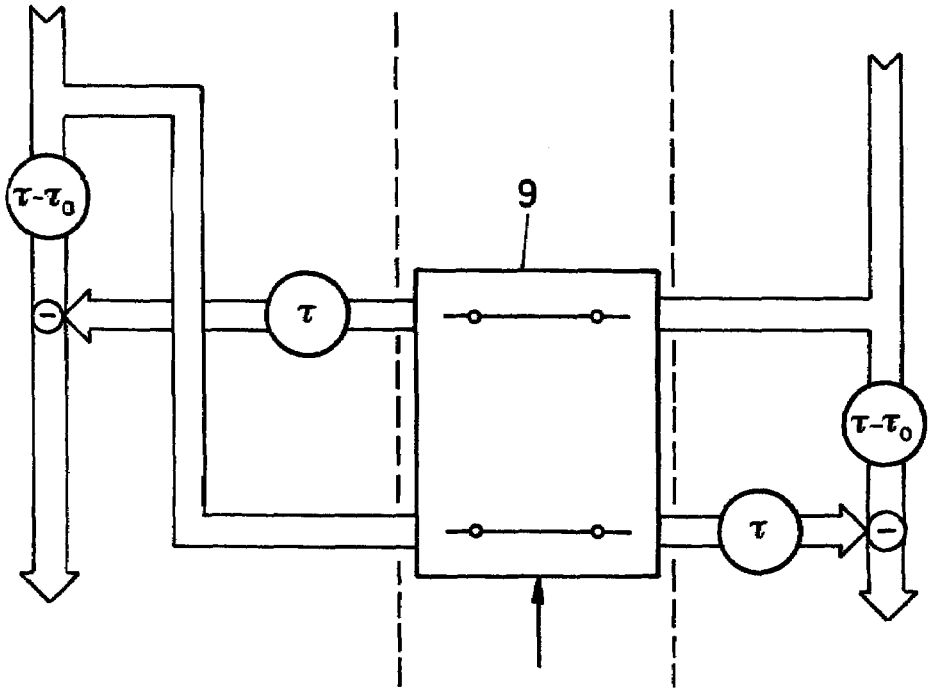
Figure 7:
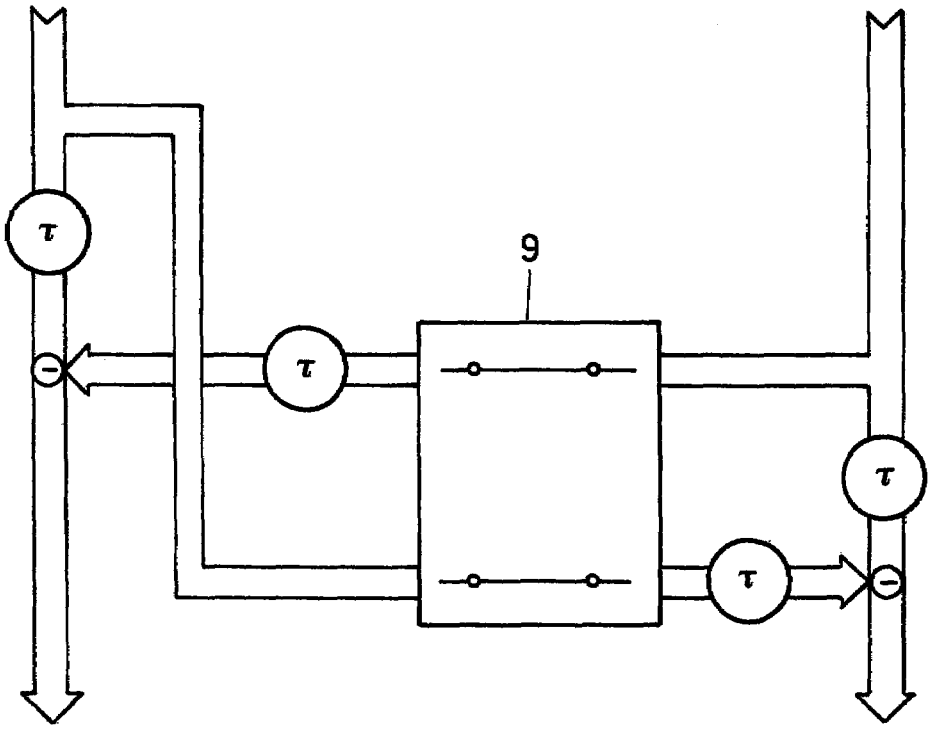
Figure 8:
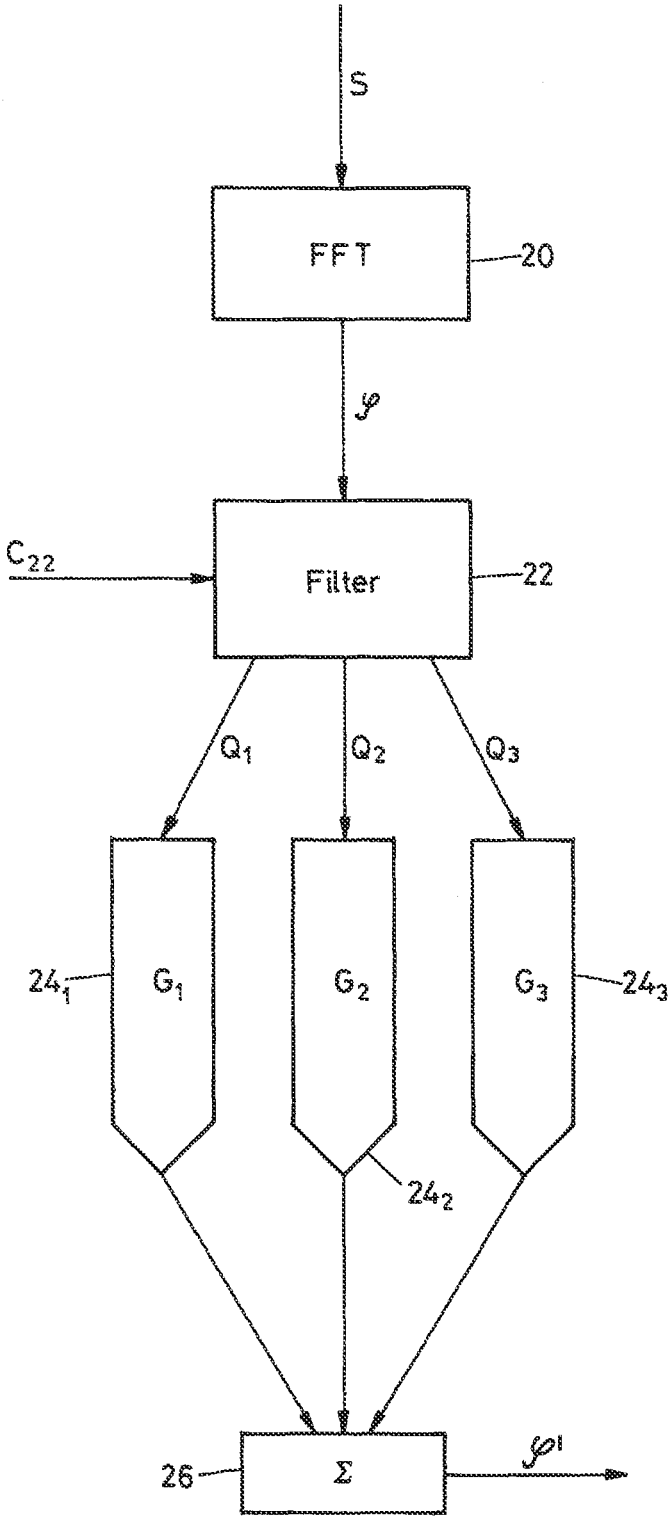
Figure 9:
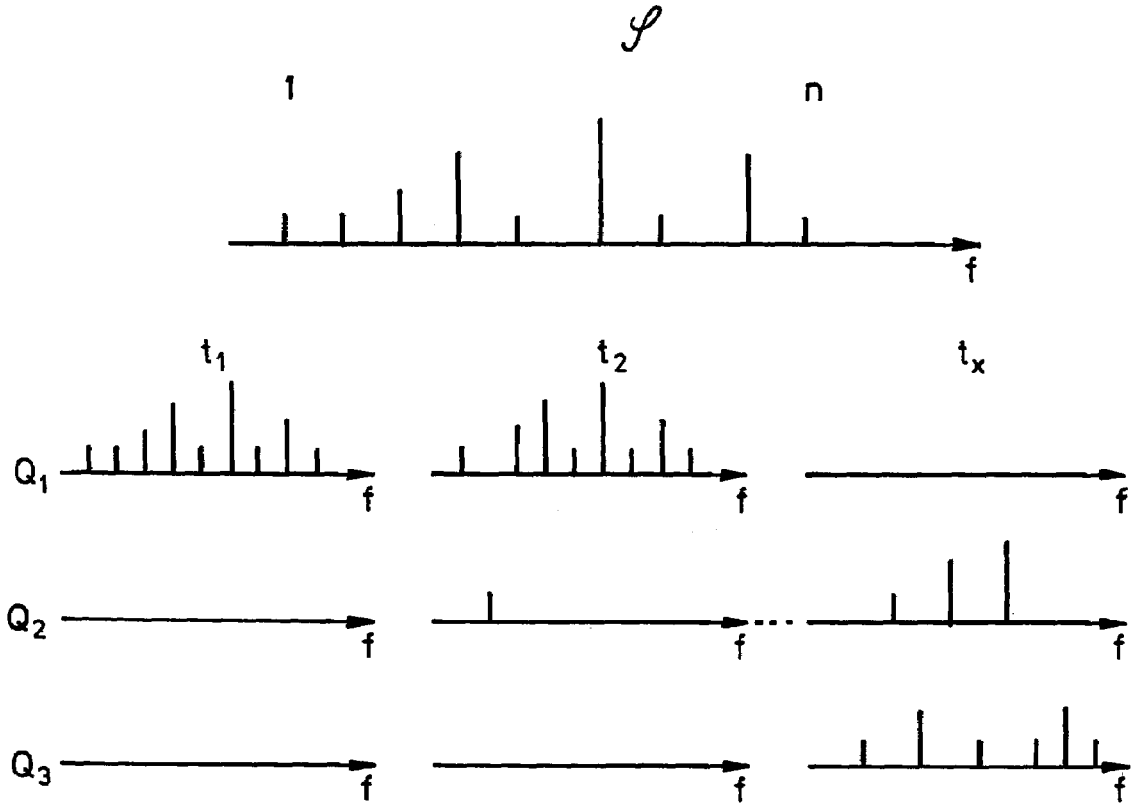
Figure 10:
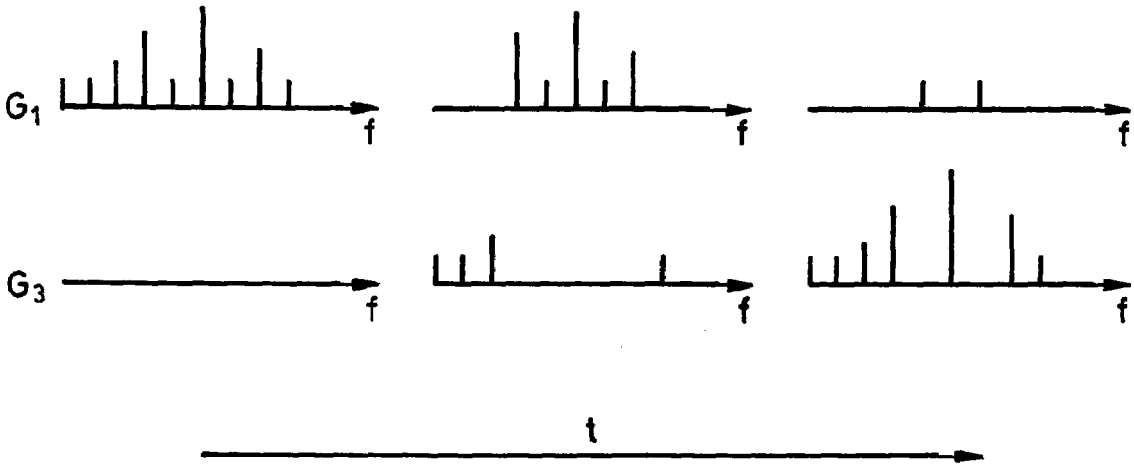
Figure 11:
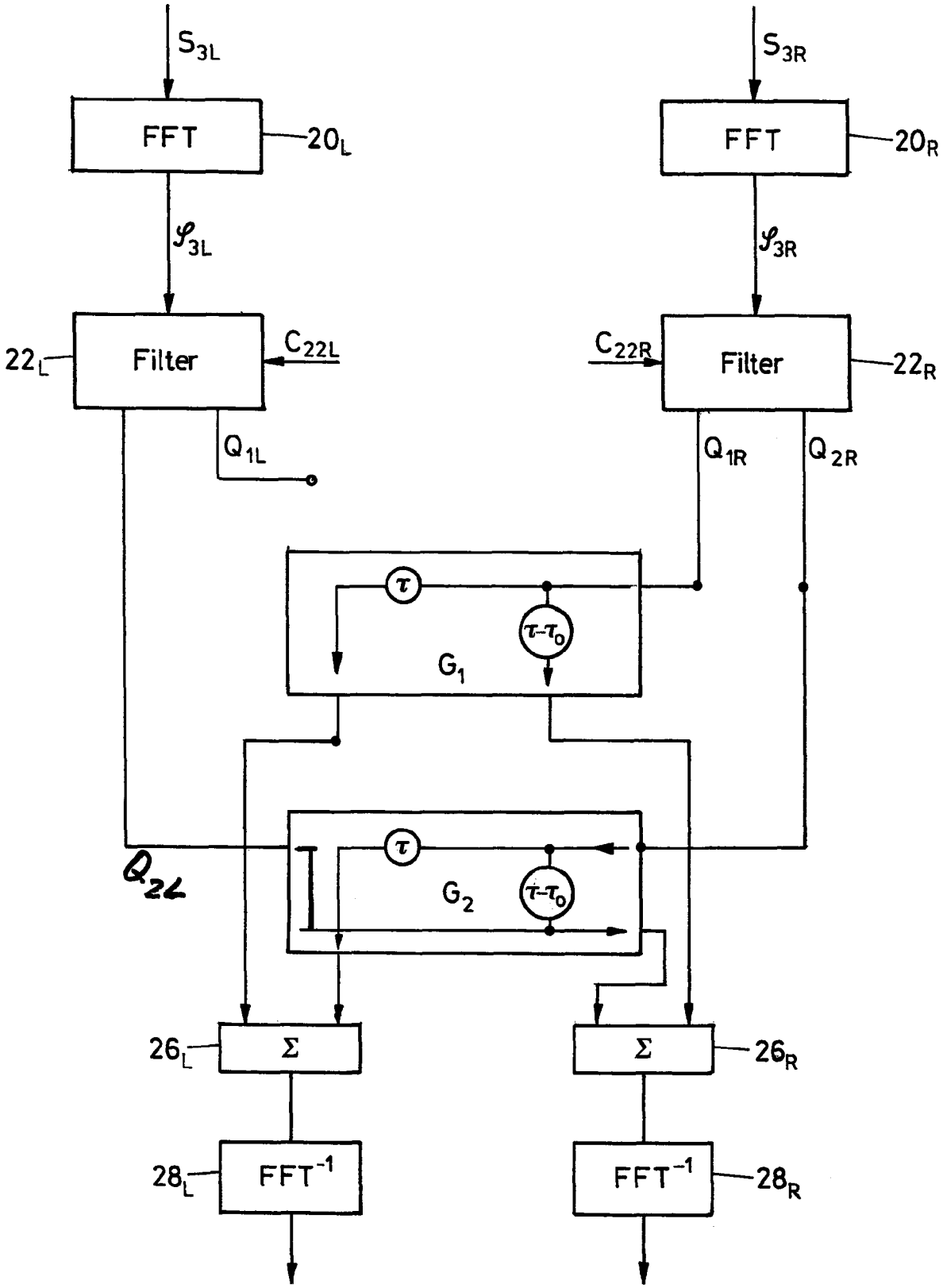

The figures show:

FIG. 1 simplified, a signal-flow/functional block diagram of a binaural hearing system, which is used for manufacturing the audible signals according to the present invention;

FIG. 2 in a representation in analogy to that of FIG. 1, a first embodiment of the present invention to manufacture the audible signals;

FIG. 3 a schematic top-to-bottom view of individual's head, defining DOA angle with respect thereto and specific areas of space;

FIG. 4(*a*) to (*d*) polar diagram of beam-forming ability of the HRTF and of a cardioid technical beam-former at different frequencies;

FIG. 5 a further embodiment for operating the method according to the present invention and in a representation in analogy to that of FIGS. 1 and 2;

FIG. 6 in a representation in analogy to that of FIG. 5, a part thereof differently operated as a further embodiment of operating the method according to the invention;

FIG. 7 in a representation in analogy to that of FIG. 6, still a further embodiment of operating the method according to the present invention;

FIG. 8 in a simplified functional block/signal-flow diagram, signal processing by alternative transfer functions;

FIG. 9 operating switch-over from signal processing from a first transfer function to a second transfer function according to FIG. 8 and performed according to the present invention under a further aspect;

FIG. 10 in a representation according to that of FIG. 9, a further example of switch-over according to the present invention and with an eye on the present invention under the aspect of audio signal manufacturing, and FIG. 11 in a simplified functional block/signal-flow diagram of a binaural hearing system as of FIG. 1, the structure thereof when operated according to the present invention under its second aspect, namely of transiting from a first to a second processing mode.

As was already addressed the principal of the present invention is to apply in a binaural hearing system binaural processing only if necessary and to simplify wherever possible such binaural processing so as to reduce over the operating time of the binaural hearing system, power consumption which is especially due to increased processing requirements necessary for binaural signal processing.

In the following detailed description several signal processing modes shall be described, at least a part thereof being selectively activated in dependency of the acoustical surrounding of an individual wearing a binaural hearing system and as e.g. determined by a classifying procedure.

In FIG. 1 there is shown by means of a signal-flow/functional-block diagram a binaural hearing system as addressed by the present invention. An individual I wears a right-ear and a left-ear hearing device $\mathbf{1}_L$ and $\mathbf{1}_R$. Each of the hearing devices comprises a respective input converter arrangement $\mathbf{3}_L$ and $\mathbf{3}_R$, also referred to as "microphone arrangement" $\mathbf{3}_L$ and $\mathbf{3}_R$. The microphone arrangements, in fact acoustical-to-electrical converter arrangements, comprise one or more than one acoustical-to-electrical converters, e.g. microphones. At the outputs $A_{3L}$ and $A_{3R}$ of the microphone arrangements electrical signals $S_{3L}$ and $S_{3R}$ are generated. These signals depend from the input acoustical signals to the microphone arrangements $\mathbf{3}_L$ and $\mathbf{3}_R$. If monaural beam-forming is performed at one or both of the hearing devices $\mathbf{1}_L$, $\mathbf{1}_R$, either with a fixed inadaptable beam characteristic or even with a characteristic which may be adapted to the momentarily prevailing acoustic needs, one can assume such beam-forming being performed in the respective microphone arrangements $\mathbf{3}_L$ and $\mathbf{3}_R$. Also some signal preprocessing as e.g. amplifying, analog to digital conversion, filtering etc., may be performed in these units. It is nevertheless merely a question of where the delimitation between microphone arrangement and subsequent signal processing is drawn when defining which signal processing is performed in which of the units as drawn in FIG. 1.

Processing signals $S_{3L}$ and $S_{3R}$ input at $E_{5L}$, $E_{5R}$ to signal processing units $\mathbf{5}_L$ and $\mathbf{5}_R$ results in signals $S_{5L}$, $S_{5R}$ at respective outputs $A_{5L}$ and $A_{5R}$ of the signal processing units which are input to respective inputs $E_{7L}$ and $E_{7R}$ of output electrical-to-mechanical converter arrangements $\mathbf{7}_L$ and $\mathbf{7}_R$, also referred to as "speaker arrangements" $\mathbf{7}_L$, $\mathbf{7}_R$.

The binaural hearing system of FIG. 1 further comprises a signal transmission link 9 for cross-data-transmission between the hearing devices $\mathbf{1}_L$ and $\mathbf{1}_R$. The transmission link 9 may be wireless or wirebound. In the left-ear signal processing unit $\mathbf{5}_L$ a signal which is dependent from the input signal $S_{3L}$ is combined with a signal which is dependent from the output signal $S_{3R}$ as transmitted via transmission link 9.

By the complex and normally frequency-dependent weighting factors $\alpha_L$ and $\beta_L$ which are controllably variable, the degree of dependency of signal $S_{5L}$ from $S_{3L}$ and $S_{3R}$ is established.

In the signal processing unit $\mathbf{5}_R$, in analogy, a weighted signal combination of $S_{3L}$ and $S_{3R}$ is performed, with respective variable complex and frequency-dependent factors $\alpha_R$ and $\alpha_R$.

The weighting factors $\alpha_L$, $\alpha_R$, $\beta_L$ and $\beta_R$ are controlled from the result of classification of the momentarily prevailing acoustical surrounding of the individual I as performed by a classifier unit 11 generating the respective control signals $C(\alpha,\beta)$.

In FIG. 2 there is schematically shown in a representation in analogy to that of FIG. 1 the binaural hearing system as of FIG. 1 performing signal processing according to the present invention. The input converter arrangement of one of the two hearing devices, according to FIG. 2 of the right-ear device, $\mathbf{3}_R$, is conceived e.g. to have an omni-directional technical beam-forming characteristic. The output signal $S_{3R}$ of the addressed input converter arrangement $\mathbf{3}_R$ is applied to the signal processing unit $\mathbf{5}_R$. The input signal $S_{5R}$ to the right-ear speaker arrangement $\mathbf{7}_R$ is made dependent from the output signal of the microphone arrangement $\mathbf{3}_R$. The transmission of a signal dependent from the output signal $S_{3L}$ of the left-ear microphone arrangement $\mathbf{3}_L$ is substantially disabled as schematically shown in the transmission unit 9 by the open connection.

Thus, the input signal $S_{5R}$ of the right-ear speaker arrangement $\mathbf{7}_R$ is practically exclusively dependent from the output signal of the microphone arrangement $\mathbf{3}_R$ of the same device $\mathbf{1}_R$.

On the other hand, signal transmission dependent from the output signal $S_{3R}$ of microphone arrangement $\mathbf{3}_R$ to the input signal $S_{5L}$ of the speaker arrangement $\mathbf{7}_L$ at the left-ear device $\mathbf{1}_L$ is enabled as shown in the transmission unit 9 of FIG. 2 by the closed connection.

The weighting factor $\alpha_L$ as of FIG. 1 is selected to be approx. zero. Thereby, the input signal $S_{5L}$ becomes practically exclusively dependent from the output signal $S_{3R}$ of the right-ear microphone arrangement $\mathbf{3}_R$.

As explained up to now, signal processing exploits exclusively the microphone arrangement at one of individual's ears to feed the input signals to the speaker arrangements of both ears of the individual.

The signal processing as shown in FIG. 2 is applied whenever the classifier unit 11 detects an acoustical signal source which is located in a specific area $F_1$ as will be explained with the help of FIG. 3.

In FIG. 3 there is schematically shown individual's head I. Direction of arrival DOA is defined counter clockwise with respect to the projection of the sagittal plane SP on a horizontal plane. Signal processing according to FIG. 2 is performed whenever an acoustical signal source is located in a range of DOA $$45° \leqq DOA \leqq 135°$$

or $$225° \leqq DOA \leqq 315°$$

and to a limited distance from individual's ear d which may be $$0 \leqq d \leqq 0.3 \text{ m}$$

Such acoustical situation, where the acoustical source to be perceived is within the spatial area F1 is especially encountered in telephone applications.

The dominating hearing device, as of FIG. 2 the right-ear hearing device $\mathbf{1}_R$, is the ipsi-lateral hearing device. In this acoustical situation, i.e. perception of an acoustical source in the spatial area $F_1$, delaying the signal output at the contra-lateral speaker arrangement with respect to the signal output at the ipsi-lateral speaker arrangement is established by a fixed amount of time.

Thus, the complex weighting factors $\beta_L$ and $\alpha_R$ are set to provide for the time delay $\tau_o$ between the respectively output mechanical signals $S_{ML}$, $S_{MR}$. According to FIG. 2 this is realized by group delay $\tau$ provided by a wireless communication link 9 and a delay $(\tau-\tau_o)$ provided by setting the weighting factor $\alpha_R$.

We have further mentioned that the ipsi-lateral microphone arrangement, according to FIG. 2 $\mathbf{3}_R$, is or may be operated in the signal processing technique of FIG. 2 with omni-directional beam characteristic. This resides on the following recognition:

In the FIGS. 4*a* to 4*d* there is shown the natural beam-forming characteristics of the HRTF at frequencies of 500 Hz, 1 kHz, 2 kHz, 4 kHz. It might be seen that at 2 kHz and above the HRTF provides for a natural beam-forming which is very similar to that of a cardioid-type microphone. The head shadow of the individual provides for an increased amplification on the ipsi-lateral side by about 5 dB compared with the amplification towards the contra-lateral side. Therefore and with an eye on FIG. 2, the HRTF provides for sufficient beam-forming at the ipsi-lateral hearing device, so that no additional technical beam-forming is necessitated at the "primariy", the ipsi-lateral input converter arrangement.

ILD compensation, which is possibly necessary for optimizing individual's perception, is realized e.g. by respective adjustment of $\beta_L$, which according to FIG. 2 also provides for the delay $\tau$. Compensation of possible mismatch of the microphone arrangements may not be necessary in the case considered.

Because the contra-lateral speaker arrangement too is fed with a signal which practically exclusively depends from the output signal of the ipsi-lateral microphone arrangement, an improved signal level and signal-to-noise ratio from the ipsi-lateral side—compared to the contra-lateral side—is exploited. The signal processing substantially necessitates only—except possibly control data—a one-directional transmission from the ipsi-lateral to the contra-lateral hearing device with a constant time delay, so that relatively small processing power and supplying power is needed to operate this signal processing mode.

In context with FIG. 2 we have addressed that by establishing the weighting factor $\alpha_L$ to be at least approximately zero, the dependency of the input signal to the contra-lateral speaker arrangement $\mathbf{7}_L$ from the output signal of the contra-lateral microphone arrangement is substantially disabled. This is not absolutely necessary. It may suffice to significantly reduce the dependency of the input signal to the contra-lateral speaker arrangement from the output signal of the contra-lateral microphone arrangement relative to such dependency from the output signal of the ipsi-lateral microphone arrangement to achieve the advantages as addressed above.

In FIG. 5 there is shown a further mode of signal processing additionally to the signal processing mode as has been discussed in context with the FIGS. 2 to 4.

In FIG. 5 there is shown in a representation in analogy to that of FIG. 1 the binaural hearing system which is controlled to also allow operating in the processing mode as of FIG. 2. The right-ear side of the binaural hearing system of FIG. 5 is again the ipsi-lateral side. The differences to the processing mode as of FIG. 2 are:

The input signal of the ipsi-lateral speaker arrangement $7_R$ is dependent from the output signal $S_{3L}$ of the contra-lateral microphone arrangement too. The weighting factor $\beta_R$ provides for the delay $\tau$ as does the weighting coefficient $\beta_L$. Thereby, signals which originate from the contra-lateral side arrive at the ipsi-lateral side delayed by $\tau_o$ with respect to signals sensed at the ipsi-lateral microphone arrangement, which amount of delay time is again selected to be at least approx. equal to the time amount a signal in the hearable frequency band needs to propagate from one ear along individual's head to the other ear.

The signal which is transmitted over transmission link 9 from the contra-lateral hearing device to the ipsi-lateral hearing device is subtracted from the signal originating from the ipsi-lateral microphone arrangement. This results in binaural beam-forming, whereat a pronounced amplification minimum is established in contra-lateral direction.

Note that in the embodiment of FIG. 5 again the two microphone arrangements $3_L$, $3_R$ may be selected to be omnidirectional. Clearly and if necessary, technical monaural beam-forming abilities may be provided at the two hearing devices, possibly controllably variable as a function of the result of classification in unit 11, so as to further improve signal-to-noise ratio.

The signal processing as shown in FIG. 5, which introduces additional binaural beam-forming ability compared with the embodiment of FIG. 2, is applied there where the acoustical source to be perceived is not anymore in close proximity of the ipsi-lateral ear, so that e.g. additional signal-to-noise improvement is necessary.

This is especially true in the spatial area F2 as shown in FIG. 2, i.e. at distances d larger than 0.3 m.

Whereas for perceiving acoustical sources in the spatial area $F_2$ the dependency of the input signal of the contra-lateral speaker arrangement from the output signal of the contra-lateral microphone arrangement may be substantially disabled, for perceiving acoustical sources outside the DOA according to $F_1$, $F_2$, $\alpha_L$ is not minimized towards zero, but signal processing according to FIG. 5 is rather performed symmetrically as shown in FIG. 6. Thereby, this binaural beam-forming mode is only established for source localization if necessary.

As may be seen in FIG. 4 the HRTF as exploited in the embodiment of FIG. 2 to enhance ipsi-lateral source perception provides in the direction of approx. 315 to 330° for the right ear and, in analogy, of approx. 30 to 45° for the left ear, an amplification maximum. In the combination with the embodiment of FIG. 5 there results beam-forming with maximum amplification still for a DOA of 315 to 330° and of 30 to 45°, but with a significantly better attenuation (negative relative amplification) of signals with a DOA of about 180°. This is exploited in the embodiment as shown in FIG. 6, where signal processing is performed mirror-symmetrically, as perfectly clear to the skilled artisan comparing the embodiments of FIG. 5 and of FIG. 6.

Reconsidering the object of performing binaural beam-forming, one of its objects is to establish to the individual the ability to localize acoustical sources. Whereas improving signal-to-noise ratio may be resolved purely by monaural beam-forming, such monaural beam-forming may not establish such ability.

With an eye on FIG. 3 we have noted that binaural signal processing and beam-forming according to FIG. 2 suffices to establish proper source localization, whenever such source is in the area $F_1$ of FIG. 3. Processing power for such binaural beam-forming and thus power consumption are thereby kept low.

Acoustical sources, which are to be perceived in the area $F_1$ are especially sources as occurring in telephone applications.

The adjacent area $F_2$ as of FIG. 3 is served by signal processing as has been shown in FIG. 5. In spite of the fact that, for proper localization of acoustical sources in this area $F_2$, higher technical requirements are to be fulfilled with respect to binaural signal processing and "catching" of the acoustical source, this is achieved by the embodiment of FIG. 5 with relatively small processing power and power consumption.

Still with the target to minimize overall processing power and power consumption for the binaural hearing system during operation, there may be selected a further area of acoustical surrounding where binaural beam-forming may be minimalized, keeping in mind that one of its primary purposes is to allow proper source localization rather than to improve signal-to-noise ratio.

In a further spatial area denoted by $F_3$ in FIG. 3, which may be approximated by a DOA of at most 45° and of at least 315°, there is no need for technical binaural beam-forming, i.e. in this range the two hearing devices $1_L$ and $1_R$ as of FIG. 1 may be operated independently merely with the respective monaural beam-forming for signal-to-noise improvement.

In a possibly remaining spatial area between $F_1$, $F_2$ and $F_3$ signal processing may be performed as has been shown in FIG. 6.

Thereby, in a large percentage of the acoustical surrounding situations a technical, binaural beam-forming signal processing is applied if at all, which is of low processing power and power supply requirement.

The embodiment as shown in FIG. 7, in a representation in analogy to that of FIG. 6, provides for technical binaural beam-forming for stereo enhancement or stereo widening effect. Thereby, there is achieved a binaural beam-forming characteristic approximately showing, in polar representation, an "8" with direction of minimum amplification at zero and 180°.

In all the embodiments of signal processing which have been described it is highly advantageous to exploit the HRTF natural beam-forming ability. Nevertheless, it must be noted that the beam-forming ability of HRTF only starts at frequencies at and above 2 kHz. Thus, it might be advisable to provide the respective monaural cardioid beam-forming for lower frequencies technically. Thus, it might be advisable to provide technical beam-forming which operates e.g. with a cardioid characteristic, up to about 1 kHz and to exploit, for higher frequencies, the HRTF function and its natural beam-forming ability. To do so, in at least two spectral ranges different signal processing is to be established. This may easily be realized once the signal involved is time-domain to frequency-domain converted. Then different spectral components of the addressed signal are easily differently processed. Another aspect which is considered per se inventive is that changeover from one signal processing mode to the other should not cause artifacts to the individual and should thus be performed in a fading manner. This object too may be resolved in an inventive manner upon the respective signal having been transformed from time-domain into frequency-domain.

In FIG. 8 there is schematically shown by means of a signal flow/functional block diagram a method according to a further aspect of the present invention, namely of fadingly switching from one signal dependency mode to another. This technique may nevertheless be applied wherever a signal is to be processed subsequently via different transfer functions and transition shall be controlled.

According to FIG. 8 a signal S to be processed is subjected to a time-domain to frequency-domain conversion as by an FFT unit 20. By the time-domain to frequency-domain conversion the signal is structured in a number of spectral components. The frequency-domain converted signal S is fed to a generic fading unit, in fact generically a filter unit 22. The filter unit 22 is a selective filter bank, whereat the spectral components of the signal S let us say with the components of interest No. 1 to n are grouped in at least two groups, according to FIG. 8 e.g. in three groups $Q_1$, $Q_2$, $Q_3$. The total number of spectral components in the groups $Q_1$ to $Q_3$ is n. By means of a control input $C_{22}$ the selectivity of filter 22 is varied, i.e. the number of spectral components momentarily assigned to each of the groups, as an example the three groups $Q_1$ to $Q_3$. This shall be exemplified with the help of FIG. 9. In FIG. 9 there is first shown at "S" the spectral components of interest of signal S. At a first point of time $t_1$ all the spectral components of S are assigned to group $Q_1$, group $Q_2$ and $Q_3$ are empty. Controlled by control input $C_{22}$, in a second moment of time, $t_2$, one of the spectral components, purely as an example, is assigned to group $Q_2$, group $Q_1$ lacks the addressed component and group $Q_3$ is still empty. Still as an example, in a later time moment $t_x$, group $Q_1$ is empty and all the spectral components of signal S are controllably split upon the groups $Q_2$ and $Q_3$.

As shown in FIG. 8 each of the groups $Q_1$ to $Q_3$ is assigned to one output of filter unit 22, which is operationally connected to a specific transfer function, named $G_1$ to $G_3$ in FIG. 8. The three transfer functions $G_1$ to $G_3$ are, according to FIG. 8, assigned to three processing units $\mathbf{24}_1$ to $\mathbf{24}_3$. The output signals of the processing unit $\mathbf{24}_1$ to $\mathbf{24}_3$ are summed in a summing unit 26, resulting in a result signal S'. As may be clearly seen by the skilled artisan, in applying FIG. 9 to processing according to FIG. 8 at $t_1$ the overall interesting spectral components 1 to n are processed by $G_1$, resulting in S' being $G_1 \cdot S$.

In moment $t_2$ one of the spectral components is processed in $G_2$, the remaining spectral component still in $G_1$. At $t_x$ the signal S is parallel processed frequency-selectively in $G_2$ $G_3$. Now if we consider under a first aspect of the just addressed frequency-selective processing technique beam-forming by the HRTF, which starts to become effective at 2 kHz and as was addressed beam-forming below of 2 kHz by means of technical beam-forming, it becomes most evident that by the structure as shown in FIG. 8 processing $G_1$ will be technical beam-forming for spectral components up to 2 kHz and e.g. $G_2$ will be a transfer function of "unity" for spectral components at and above 2 kHz, thereby to consider the beam-forming ability of the HRTF.

By the control input $C_{22}$ the sequence in time of spectral components assigned to each of the groups provided is controlled. Thus and with an eye on fading a signal processing from a transfer function $G_1$ steadily to a transfer function $G_3$ without making use of the transfer function $G_2$, it is most evident to the skilled artisan that, with an eye on FIG. 9, first all the spectral components are assigned to group $Q_1$ as shown at moment $t_1$ and finally all the spectral components will be assigned to group $Q_3$, leaving no spectral components left in group $Q_1$. This is shown in FIG. 10, which is absolutely clear to the skilled artisan having understood the sequences in FIG. 9. Further and with an eye on FIG. 10, group $G_2$ may act as an intermediate or temporary group.

Therefrom, it becomes clear that by controlling the group membership of each of the spectral components of a signal to be processed variably in time, as by the control input $C_{22}$, and assigning to each of the groups different processing transfer functions, overall processing may fadingly be switched from one processing to the other processing mode.

This technique is applied in a good embodiment of the present invention under its first aspect, for fadingly switching between the different signal processing modes as have been described e.g. in context with FIG. 2, FIG. 5, FIG. 6, FIG. 7.

In FIG. 11 there is shown the technique as has been exemplified with the help of the FIGS. 8 to 10 for fadingly switching from signal processing according to FIG. 2 to signal processing according to FIG. 5. The output signals $S_{3L}$ and $S_{3R}$ are time-domain to frequency-domain converted in converter units $\mathbf{20}_L$ and $\mathbf{20}_R$, resulting in the frequency-domain signals $S_{3L}$ and $S_{3R}$. These signals are fed to fading filter units $\mathbf{22}_L$ and $\mathbf{22}_R$ having respectively, outputs $Q_{1L}$ and $Q_{1R}$, $Q_{2L}$ and $Q_{2R}$. A first transfer function $G_1$ accords with the embodiment of FIG. 2 and a second transfer function $G_2$ with the embodiment of signal processing according to FIG. 5. The group $Q_1$ of spectral components is processed by $G_1$, thus according to FIG. 2, the second group of spectral components $Q_2$ by transfer function or processing $G_2$, thus according to the embodiment of FIG. 5. The results of these two processings with different transfer functions $G_1$ and $G_2$ are summed in respective summing units $\mathbf{26}_L$ and $\mathbf{26}_R$, the output thereof being frequency-domain to time-domain converted at units $\mathbf{28}_L$ and $\mathbf{28}_R$, leading possibly after digital-to-analog conversion to the signals $S_{5L}$, $S_{5R}$ of FIG. 1. By means of the synchronized control signals $C_{22L}$ and $C_{22R}$ the membership of each of the interesting frequency components to the groups $Q_1$ and $Q_2$ is controlled, so that for switching from processing according to FIG. 2 to processing according to FIG. 5, all interesting frequency components are first members of group $Q_1$ and, staggered over time, are more and more shifted from a membership in group $Q_1$ to membership in group $Q_2$. Fadingly switching over is then terminated when all the frequency components of interest are transferred to be membership of group $Q_2$ and group of $Q_1$ is in fact "empty".

By the present invention and under a first aspect binaural beam-forming modes have been proposed which are assigned to specific situations of acoustical surrounding and which necessitate little processing power and supply power requirements. On the other hand and under another aspect of the present invention there is proposed to provide at least two processing modes assigned to specific acoustical situations which modes are of relatively small processing power and supply power consumption and between which one may switch system operation.

Still under a further aspect it has been proposed inventively a method for controlled switching from one processing mode to another, which is ideally suited for fadingly switching from one signal processing mode to another according to and in the first and second aspects of the present invention.

The invention claimed is:

1. A method for manufacturing an audible signal to be perceived by an individual in dependency from an acoustical signal source, said individual wearing a right-ear and a left-ear hearing device respectively with a right-ear and with a left-ear input converter arrangement and with a right-ear and with a left-ear output converter arrangement, comprising:

establishing a dependency of an input signal to the right-ear output converter arrangement from an output signal of the right-ear input converter arrangement and a dependency of the input signal of the left-ear output converter arrangement from the output signal of the left-ear input converter arrangement and disabling binaural beam-forming and operating the right-ear and left-ear hearing devices independently with respective monaural beam-forming if an acoustical source to be perceived is located in front of individual's head in a first range of direction of arrival, or DOA, which is between at most 45° and at least 315°; and establishing a predominant dependency of the input signal to the contra-lateral output converter arrangement from the output signal of the ipsi-lateral input converter arrangement if said acoustical source to be perceived is located laterally of individual's head in a second range of direction of arrival, or DOA, which is $$45° \leqq DOA \leqq 135°$$

or $$225° \leqq DOA \leqq 315°$$

relative to individual's horizontal straight-ahead direction.

2. The method of claim 1 comprising reducing dependency of said input signal of said contra-lateral output converter arrangement from the output signal of said contra-lateral input converter arrangement.

3. The method of claim 1 comprising at least substantially disabling dependency of the input signal of the ipsi-lateral output converter arrangement from the output signal of the contra-lateral input converter arrangement.

4. The method of claim 1 wherein the input signal to the ispi-lateral output converter arrangement is dependent only from the output side of said ipsi-lateral input converter within said second range of direction of arrival if said acoustical signal source is distant from one of individual's ears by at most 0.3 m and that said input signal of the ipsi-lateral output converter arrangement is dependent from the output signal of the ipsi-lateral input converter arrangement as well as from the output signal of the contra-lateral input converter arrangement in said second range of direction of arrival if said distance is more than 0.3 m.

5. The method of claim 1 comprising time delaying influence of said output signals of said right-ear and of said left-ear input converter arrangements respectively on said input signals of said left-ear and of said right-ear output converter arrangements more by a fixed amount than time delaying influence of said output signals of said right-ear and of said left-ear input converter arrangements on said input signals of said right-ear and of said left-ear output converter arrangements respectively.

6. The method of claim 5, said fixed amount being selected at least approximately equal to the time an acoustical signal in the hearable frequency band needs to run from one ear to the other ear, around human's head.

7. The method of claim 1 comprising performing a change of signal dependency in a fading manner.

8. The method of claim 1 establishing said dependencies of said input signals of said output converter arrangements from output signals of said input converter arrangements comprising signal processing in frequency mode and performing changing a signal dependency comprising performing changing said signal dependency subsequently in time in at least two groups of spectral frequencies.

9. A method for manufacturing an audible signal to be perceived by an individual in dependency from an acoustical signal said individual wearing at least one input converter arrangement and at least one output converter arrangement;

the input signal of said output converter arrangement being dependent from the output signal of said input converter arrangement via at least two controllably interchangeable different transfer functions;

establishing time- to frequency-domain conversion upstream said transfer functions;

performing signal processing of a first group of spectral components by a first of said at least two transfer functions;

processing a second group of spectral components by said other of said at least two transfer functions;

changing signal processing of at least a part of said first group to be done by said other one of said at least two transfer functions, thereby maintaining processing of said second group by said other of said at least two transfer functions.

10. A method for manufacturing an audible signal to be perceived by an individual in dependency from an acoustical signal source, said individual wearing a right-ear and a left-ear hearing device, respectively with a right-ear and with a left-ear input converter arrangement and with a right-ear and with a left-ear output converter arrangement; the method comprising the step of controlling said right-ear and said left-ear hearing devices to operate in dependency from a direction of arrival of said acoustical signal source in either a monaural beam-forming mode or a binaural beam-forming mode wherein the devices are controlled to operate in the monaural beam-forming mode when the acoustical signal source is within one range of direction of arrival and the devices are controlled to operate in the binaural beam-forming mode when the acoustical signal source is within a different range of direction of arrival so as to perform in the monaural beam-forming mode the steps of:

generating an input signal of said right-ear output converter arrangement dependent from the output signal of said right-ear input converter arrangement;

generating an input signal of said left-ear output converter arrangement dependent from the output signal of said left-ear input converter arrangement;

and to perform in the binaural beam-forming mode one of the following steps:

a) performing binaural beam-forming by establishing an at least predominant dependency of the input signal of the right-ear and of the left-ear output converter arrangements from the output signal of the left-ear or of the right-ear input converter arrangement, respectively;

b) performing binaural beam-forming by establishing a dependency of the input signal of the left-ear output converter arrangement from the output signal of the right-ear input converter arrangement and a dependency of the input signal of the right-ear output converter arrangement from the output signal of the left-ear input converter arrangement;

c) performing binaural beam-forming by establishing a dependency of the input signal of the left-ear output converter arrangement from the output signal of the right-ear input converter arrangement and a dependency of the input signal of the right-ear output converter arrangement from the output signal of the left-ear input converter arrangement, thereby realizing a polar beam characteristic with amplification in ahead and backwards directions with respect to individual's head being lower than amplification in other directions; and d) performing binaural beam-forming by establishing a dependency of the input signal of the left-ear output converter arrangement from the output signal of the right-ear input converter arrangement and a dependency of the input signal of the right-ear output converter arrangement from the output signal of the left-ear input converter arrangement thereby realizing a polar beam characteristic with a amplification in the rear direction of individual's head being higher than amplification in other directions.

11. The method of claim 10 comprising performing step c) as stereo enhancement processing.

12. The method of claim 10 comprising performing step d) when a signal source to be perceived is situated behind individual's head and in a further predetermined range of direction of arrival, or DOA.

13. The method of claim 10 comprising performing a change of signal processing in a fading manner.

14. The method of claim 10 comprising establishing said dependencies of said input signals of said output converter arrangements from output signals of said input converter arrangements comprising signal processing in frequency-domain and performing changing a signal processing comprising performing changing said signal processing subsequently in time in at least two groups of spectral components.

15. The method of claim 10, comprising controllably transiting from a first to a second signal processing, comprising the steps of:

converting the input signals from time-domain signals to frequency-domain signals;

transiting from processing a first selected group of spectral components of the frequency-domain signals using a first transfer function and processing a second selected group of spectral components of the frequency-domain signals using a second transfer function at a first time to processing a third selected group of spectral components of the frequency-domain signals using the first transfer function and processing a fourth selected group of spectral components of the frequency-domain signals using the second transfer function at a second time different from the first time, wherein the third and fourth selected group of spectral components, respectively, comprises different spectral components than the first and second selected group of spectral components.

16. The method of claim 10 comprising performing step a) only when a signal source to be perceived is situated lateral to individual's head and in a first predetermined range of direction of arrival, or DOA.

17. The method of claim 16, further comprising performing step a) for telephone application or driver to front seat passenger communication.

18. The method of claim 16 comprising performing step b) only when a signal source to be perceived is situated in a second predetermined range of direction of arrival, or DOA, at least in part different from said first range.

* * * * *

UNITED STATES PATENT AND TRADEMARK OFFICE

CERTIFICATE OF CORRECTION

PATENT NO. : 8,483,416 B2
APPLICATION NO. : 11/456874
DATED : July 9, 2013
INVENTOR(S) : Hans Ueli Roeck et al.

It is certified that error appears in the above-identified patent and that said Letters Patent is hereby corrected as shown below:

In the Specification

Column 9, line 8, please delete "$\alpha_R$" and add -- $\beta_R$ --

Column 13, line 40, please add -- and -- after "$G_2$"

Signed and Sealed this
Twelfth Day of November, 2013

Teresa Stanek Rea

Teresa Stanek Rea
*Deputy Director of the United States Patent and Trademark Office*